US005528347A

United States Patent [19]

Kamath et al.

[11] Patent Number: 5,528,347

[45] Date of Patent: Jun. 18, 1996

[54] ADAPTIVE JAM DETECTION WINDOWS

[75] Inventors: Venkatesh H. Kamath, Fairport; Robert P. Siegel, Penfield, both of N.Y.

[73] Assignee: Xerox Corporation, Stamford, Conn.

[21] Appl. No.: 425,011

[22] Filed: Apr. 17, 1995

[51] Int. Cl.[6] ..... G03G 15/00

[52] U.S. Cl. ..... 355/205; 355/316

[58] Field of Search ..... 355/205, 206, 355/207, 308, 316; 271/259, 265.02; 364/478; 395/911, 912

[56] References Cited

U.S. PATENT DOCUMENTS 4,804,998 2/1989 Miyawaki ..... 355/14 SH
5,313,253 5/1994 Martin et al. ..... 355/205

FOREIGN PATENT DOCUMENTS 6-271149 9/1994 Japan ..... 355/207

*Primary Examiner*—Joan H. Pendegrass
*Attorney, Agent, or Firm*—Ronald F. Chapuran

[57] ABSTRACT

A method of changing the reference timing of a sheet transport control in an imaging forming device for determining the validity of the timing of a sheet by comparing the actual timing of a sheet with a a given reference timing. Actual timings for a plurality of copy sheets in relation to a predetermined sensor are stored in memory. A typical time period from the plurality of copy sheets is then determined in relation to the sensor and the reference timing for the sensor is adjusted based upon the typical time period for the sensor.

9 Claims, 7 Drawing Sheets

ADAPTIVE JAM DETECTION WINDOWS

BACKGROUND OF THE INVENTION

The invention relates to copy sheet control and, more particularly, to the capability of adjusting jam detection timing windows for selected sensors.

If imaging machines are to become more versatile in completing complex jobs, the machine control must be able to adapt to a wide variety of requirements, particularly timing requirements in an efficient manner. Normal timing deviations in a machine should not result in the declaration of an unnecessary timing fault.

Currently, in most reprographic machines a nominal preset reference is specified for paper path timing and jam detection windows. This means that all variables such as paper path geometries, paper weight, component response, speed variation and life degradation have to be accommodated with a single preset jam detection window.

U.S. Pat. No. 4,804,998 discloses a control method for deciding whether or not the transport of a sheet in a copier is normal. Sheet feed sensors, a registration sensor, a separation sensor, a fixation sensor, a discharge sensor and other sensors responsive to the ends of a sheet are provided. The actual timing of passage of a sheet sensed by one of the sensors is compared with reference timing, and the resulting increment or decrement in timing is fed back to the reference timings which are respectively, assigned to each of the other sensors that are located downstream of that one sensor. This prevents the deviation in timing from being sequentially accumulated from the upstream sensor to the downstream sensor. When the sum of the increments and decrements exceeds a predetermined value, an alarm is produced for alerting a person to such an occurrence.

A difficulty, however, with the system described in the '998 patent is that accommodations for timing deviations of a first sensor are passed on to sensors downstream, but no adjustments are made for the reference used at the first sensor or references for other sensors in the sheet path, that is, although timing adjustments are carried to downstream sensor references, no adjustments are made to downstream sensors based upon deviations from their own references. Thus, if the initial references are incorrect, the deviations passed down from upstream sensors, may in fact, result in incorrect fault signals at downstream sensors. Merely accumulating deviations from references does not account for the use of references that are inappropriate and inaccurate because of changing machine operating conditions.

Therefore a difficulty in the above prior art device is that the reference for a particular sensor can not be adjusted to account for changes in readings for that particular sensor due to causes such as abnormality of sheet drives and related components, contamination and degradation of the sensor itself. Another difficulty is that the reference for a particular sensor can not be adjusted to account for changes in readings for that particular sensor due to failure of the sensor or inherent manufacturing variations from machine to machine.

It is an object, therefore, of the present invention to provide a new and improved system for setting or adjusting the jam window reference for a sheet tracking sensor. Another object of the present invention is to use actual mean arrival time at critical monitoring stations rather than nominal preset references for setting up or adjusting sheet tracking timing control. Still another object of the present invention is to be able to selectively set sheet tracking timing parameters for a given sensor in response to variable paper path geometries, paper weight, component response, speed variation, and degradation due to aging. Other advantages of the present invention will become apparent as the following description proceeds, and the features characterizing the invention will be pointed out with particularity in the claims annexed to and forming a part of this specification.

SUMMARY OF THE INVENTION

There is disclosed a method of changing the reference timing or timing window of a sheet transport control in an imaging forming device for determining the validity of the timing of a sheet. This is done by comparing the actual timing of a sheet with a given preset reference timing. Actual timings for a plurality of copy sheets in relation to a predetermined sensor are stored in memory. A typical time period from the plurality of copy sheets is then determined in relation to the sensor and the reference timing for the sensor is adjusted based upon the typical time period for the sensor.

For a better understanding of the present invention, reference may be had to the accompanying drawings wherein the same reference numerals have been applied to like parts and wherein:

DETAILED DESCRIPTION OF THE DRAWINGS

Figure 7A:
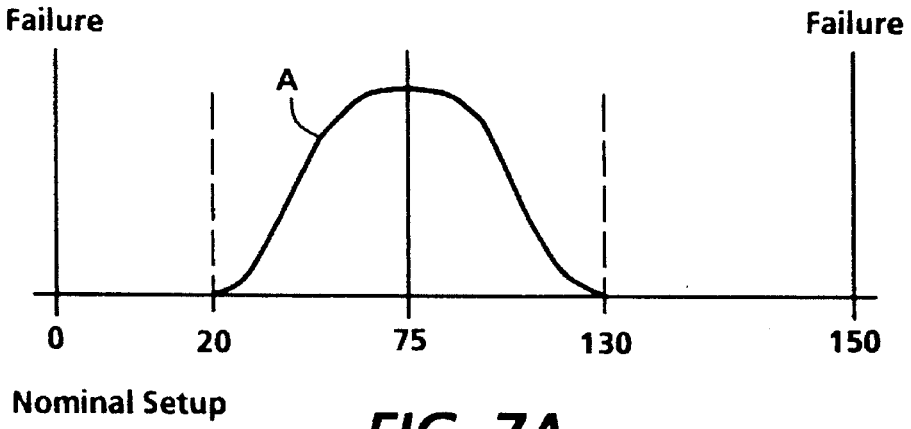
Figure 8:
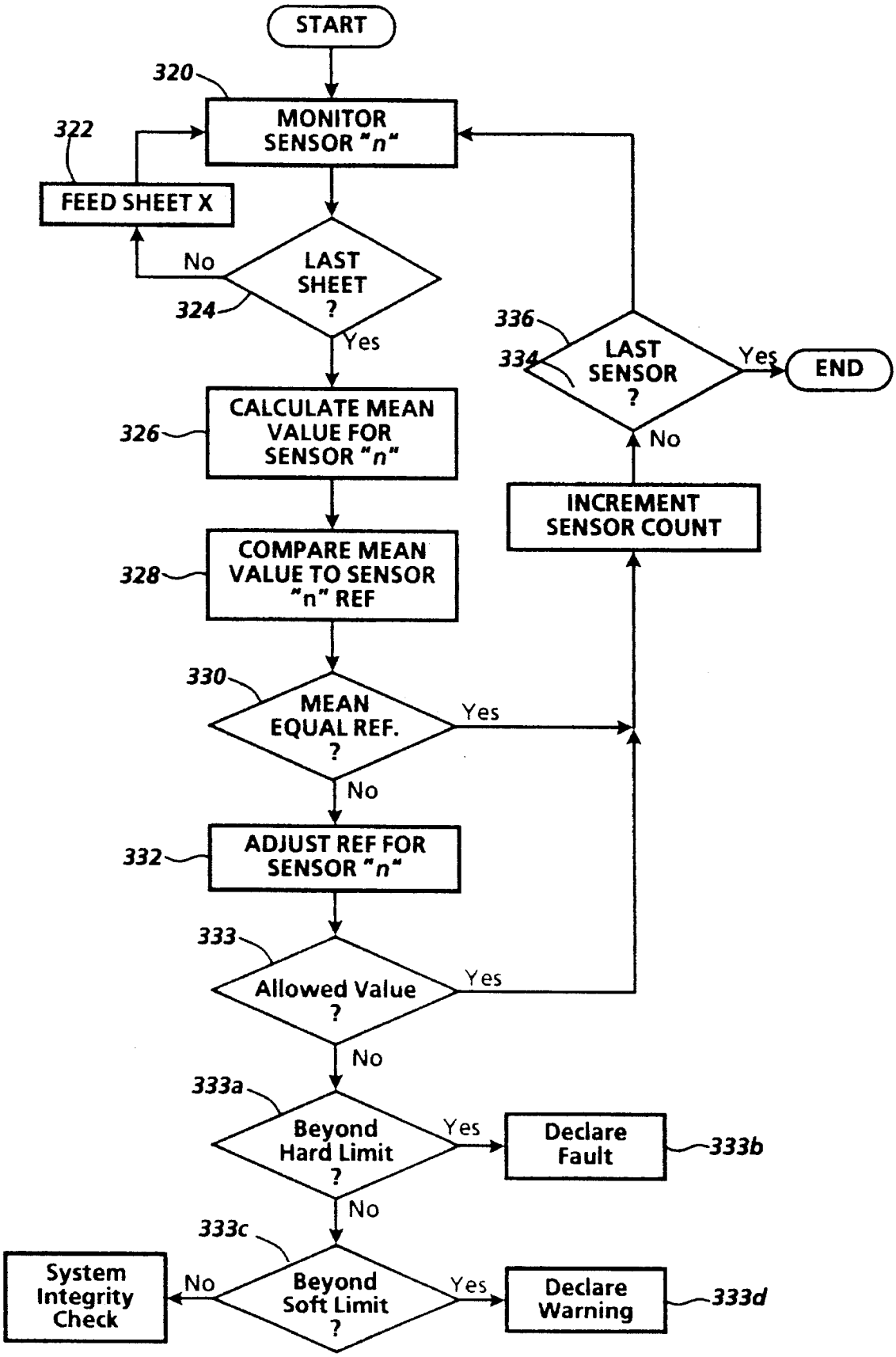

FIGS. 7A,B,C, and D illustrate sheet arrival time distribution and two methods of correction in accordance with the present invention; and FIG. 8 is a flow chart illustrating the changing of a jam detection window in accordance with the present invention.

DETAILED DESCRIPTION OF THE PREFERRED EMBODIMENT

Figure 1:
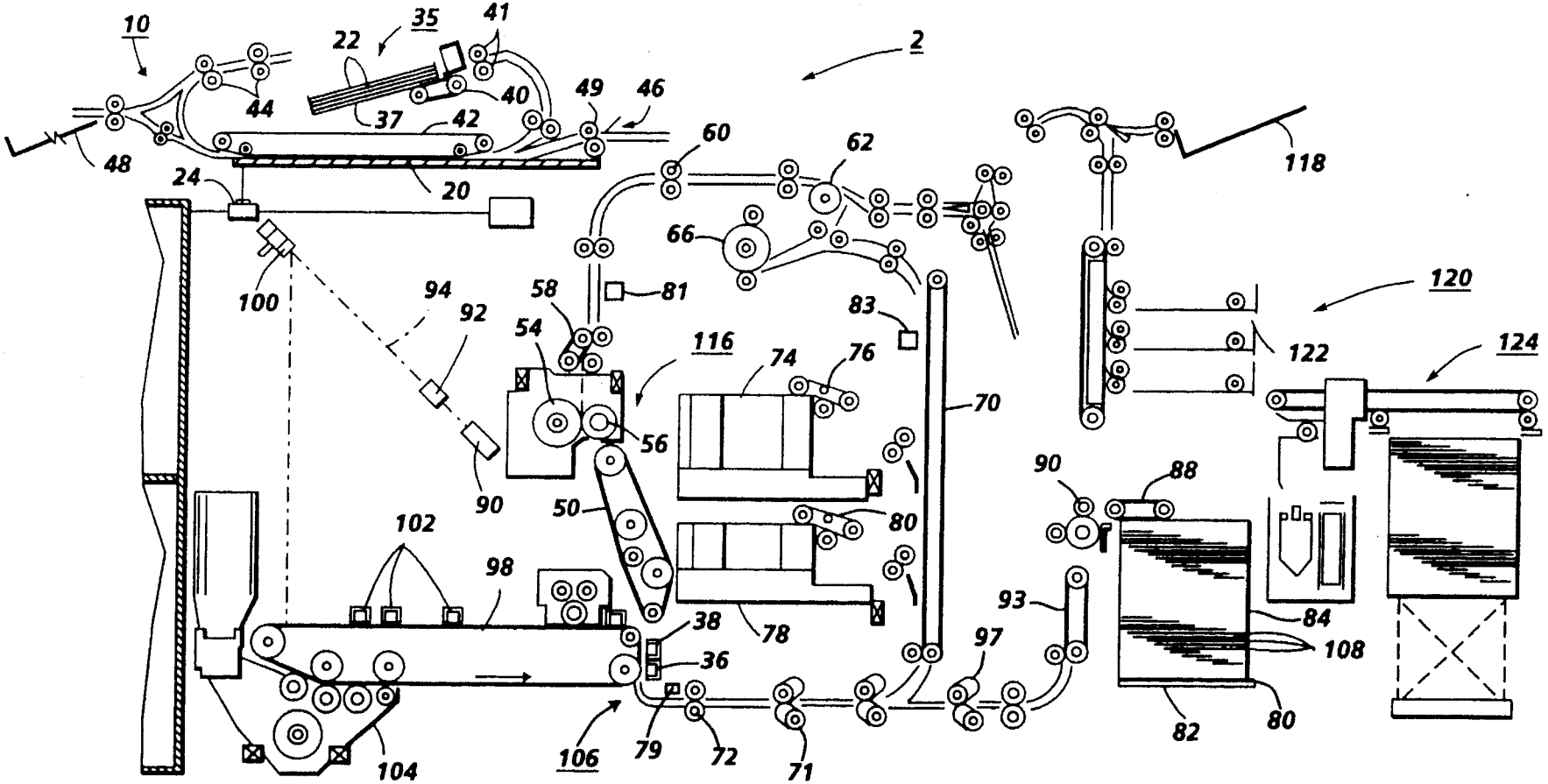
FIG. 1 is a plan view illustrating the principal mechanical components of a typical printing system incorporating the present invention.
Figure 2:
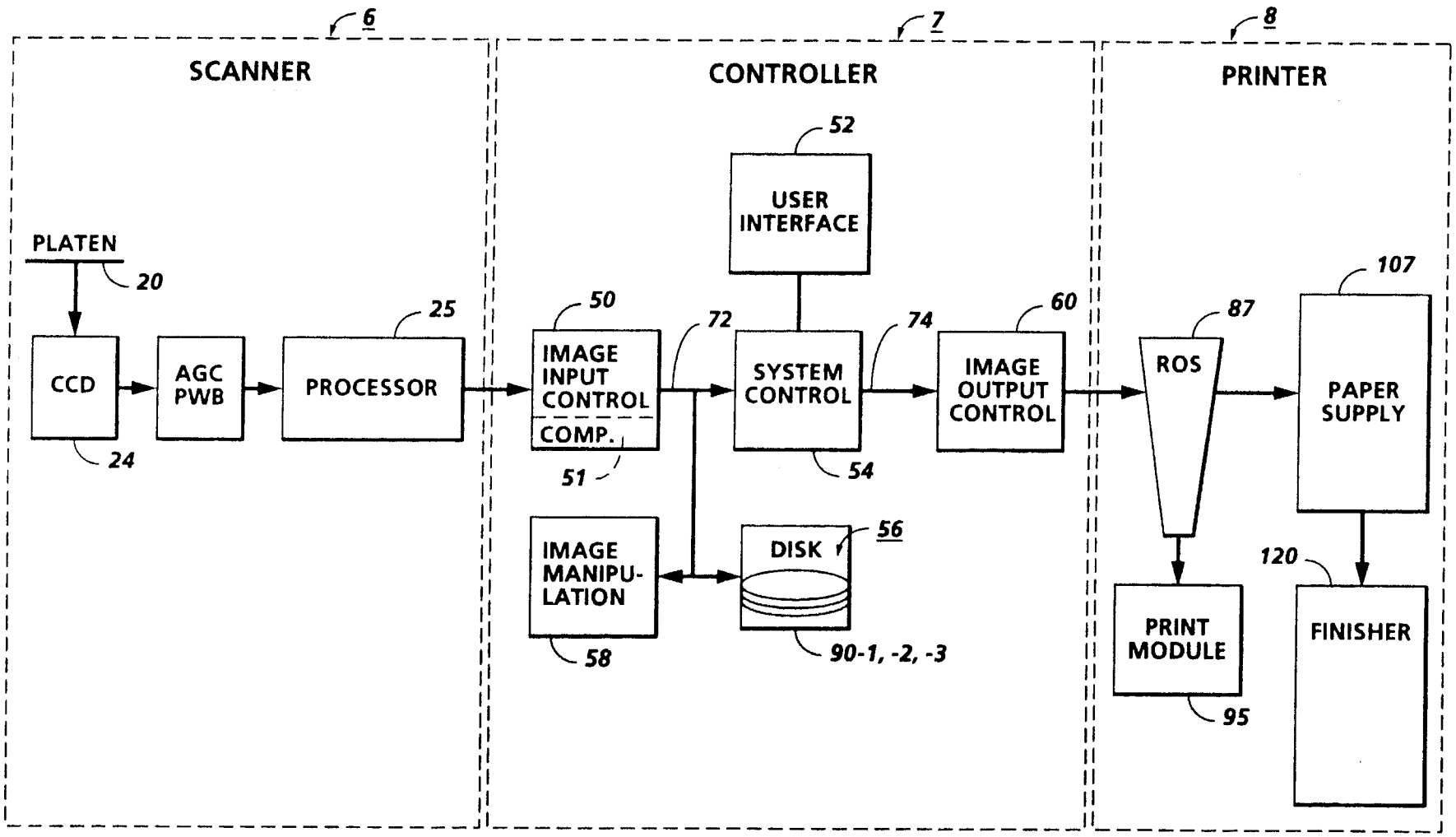
FIG. 2 is a block diagram depicting the major control elements of the printing system shown in FIG. 1.

Referring to FIGS. 1 and 2, there is shown an exemplary laser based printing system 2 for processing print jobs in accordance with the teachings of the present invention. Printing system 2 for purposes of explanation is divided into a scanner section 6, controller section 7, and printer section 8. While a specific printing system is shown and described, the present invention may be used with other types of printing systems such as ink jet, ionographic, etc.

Scanner section 6 incorporates a transparent platen 20 on which a document to be scanned is located. One or more linear arrays 24 are supported for reciprocating scanning movement below platen 20. Suitable lens and mirrors cooperate to focus array 24 on a line -like segment of platen 20 and the document being scanned thereon. Array 24 provides image signals or pixels representative of the image scanned which after suitable processing by processor 25, are output to controller section 7.

Processor 25 converts the analog image signals output by array 24 to digital and processes the image signals as required to enable system 2 to store and handle the image data in the form required to carry out the job programmed. Processor 25, for example, may provide enhancements and changes to the image signals such as filtering, thresholding, screening, cropping, etc.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and document feed rolls 41 and document feed belt 42 onto platen 20 where the document is scanned by array 24. Following scanning, the document is removed from platen 20 by belt 42 and returned to tray 37 by document feed rolls 44.

Printer section 8 comprises a laser type printer and for purposes of explanation is separated into a Raster Output Scanner (ROS) section 87, Print Module Section 95, Paper Supply section 107, and Finisher 120. ROS 95 has a laser 90, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotron 102 at a charging station preparatory to exposure by imaging beams 94. The latent electrostatic images are developed by developer 104 and transferred at transfer station 106 to print media delivered by Paper Supply section 107. The print media may comprise any of a variety of sheet sizes, types, and colors. For transfer, the print media is brought forward in timed registration with the developed image on photoreceptor 98 from either a main paper tray 110 or from auxiliary paper trays 112 or 114. The developed image transferred to the print media is permanently fixed or fused by fuser 116 and the resulting prints discharged to either output tray 118, or to finisher 120. Finisher 120 includes a stitcher 122 for stitching or stapling the prints together to form books and a thermal binder 124 for adhesively binding the prints into books.

A copy sheet is provided via de-skew rollers 71 and copy sheet feed roller 72. Sensor 79 detects the absence or presence of a copy sheet leaving roller 72. At the transfer station 106, the photoconductive belt 98 is exposed to a pre-transfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fuser 116 permanently affixing the toner powder image to the copy sheet. Preferably, fuser 116 includes a heated fuser roller 54 and a pressure roller 56 with the powder image on the copy sheet contacting fuser roller 54.

After fusing, the copy sheets are fed through a decurler 58 to remove any curl. Sensor 81 detects the absence or presence of a copy sheet leaving fuser 116. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. Sensor 83 detects the absence or presence of a copy sheet leaving inverter 66. It should be noted that various other suitable sensors distributed throughout the copy sheet path to detect appropriate copy sheet distribution are contemplated within the scope of the present invention and sensors 79, 81, and 83 are merely illustrative. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer station.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive roll 90. Roll 90 guides the sheet onto transport 93 which in cooperation with paper feed roller 97 moves the sheet to the transfer station via de-skew rollers 71 and feed rollers 72.

Controller section 7 is, for explanation purposes, divided into an image input controller 50, User Interface (UI) 52, system controller 54, main memory 56, image manipulation section 58 and image output controller 60. The scanned image data input from processor 25 of scanner section 6 to controller section 7 is compressed by an image compressor/processor. The image files, which represent different print jobs, are temporarily stored in a system memory which comprises a Random Access Memory or RAM pending transfer to main memory 56 where the data is held pending use.

UI 52 includes a combined operator controller/CRT display consisting of an interactive touchscreen, a keyboard, and a mouse. UI 52 interfaces the operator with printing system 2, enabling the operator to program print jobs and other instructions, to obtain system operating information, instructions, programming information, diagnostic information, etc. Main memory 56 has plural hard disks 90-1, 90-2, 90-3 for storing machine Operating System software, machine operating data, and the scanned image data currently being processed.

When the compressed image data in main memory 56 requires further processing, or is required for display on the touchscreen of UI 52, or is required by printer section 8, the data is accessed in main memory 56. Where further processing other than that provided by processor 25 is required, the data is transferred to image manipulation section 58 where the additional processing steps such as collation, make ready, decomposition, etc. are carried out. Following processing, the data may be returned to main memory 56, sent to UI 52 for display on the touchscreen or sent to image output controller 60.

Figure 3:
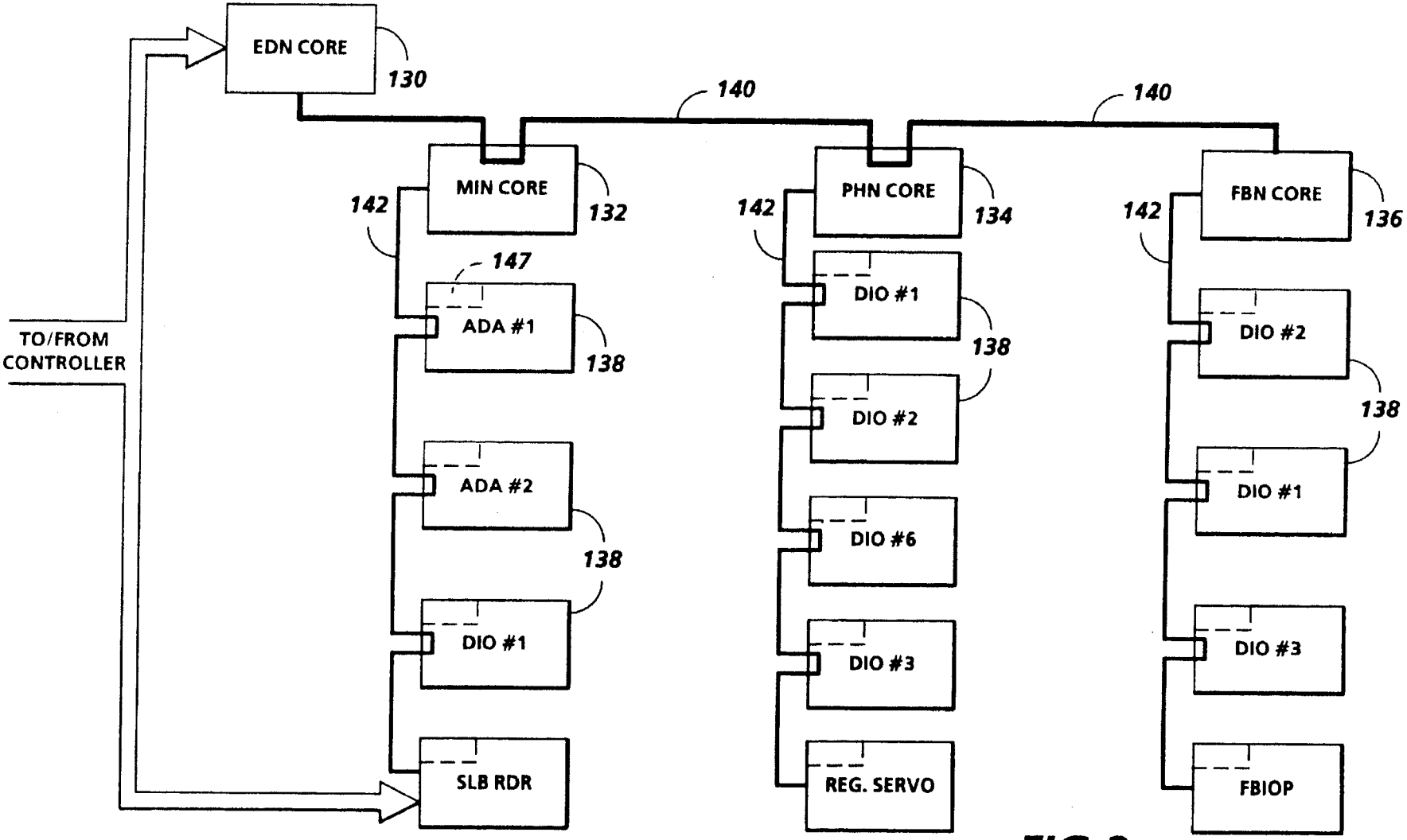
FIG. 3 is a block diagram depicting the printed wiring boards and shared line connections of the operating system of the control of FIG. 2.

Referring particularly to FIG. 3, system control signals are distributed via a plurality of printed wiring boards (PWBs). These include EDN core PWB 130, Marking Imaging core PWB 132, Paper Handling core PWB 134, and Finisher Binder core PWB 136 together with various Input/Output (I/O) PWBs 138. A system bus 140 couples the core PWBs 130, 132, 134, 136 with each other and with controller section 7 while local buses 142 serve to couple the I/O PWBs 138 with each other and with their associated core PWB.

On machine power up, the Operating System software is loaded from memory 56 to EDN core PWB 130 and from there to the remaining core PWBs 132, 134, 136 via bus 140, each core PWB 130, 132, 134, 136 having a boot ROM 147 for controlling downloading of Operating System software to the PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

It is known in the prior art to track individual documents or copy sheets of variable characteristics such as size, texture, and weight throughout the copy sheet flow process and to be able to selectively adjust machine timing and hardware responses based upon the variable copy sheet or document characteristics. For example, pending D/93204 Ser. No. 08/208,250, titled IMPROVED CONTROL OF COPY SHEETS IN PAPER PATH, filed Mar. 9, 1994, discloses an image processing apparatus for intermingling copy sheets of different characteristics on a copy sheet path including a controller for tracking the movement of the copy sheets along the copy sheet path, a sensor for determining the characteristic of each copy sheet at the beginning of the copy sheet path, logic for translating the characteristic of each copy sheet into timing adjustments, and a control element for applying the timing adjustments for each copy sheet along the copy sheet path.

Figure 4:
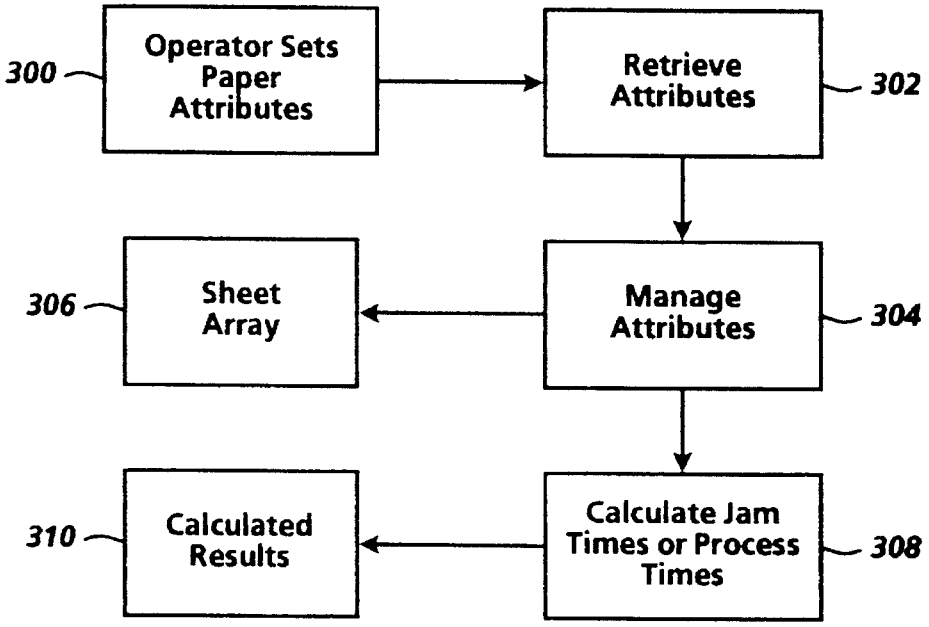
FIG. 4 is a are general flow chart illustrating the scheduling of copy sheets of different characteristics along a paper path.

In particular, with reference to FIG. 4, block 300 illustrates the operator setting paper attributes. This can be accomplished by the operator setting a particular tray to hold a specific size copy sheet and sensors attached to the tray communicating the setting for paper size to the system control. Another option is merely for the operator at the user interface to enter various copy sheet attributes such as size and type for each of a set of given trays. Another option for determining copy sheet attributes such as size is for suitably positioned sensors at the copy sheet feed trays to sense the size of the copy sheets as sheets are fed onto a conveyor or transport.

Block 302 illustrates the retrieval of the attributes into a copy sheet attribute profile processor suitably located in the system control 54. The attributes can be generally retrieved by the profile processor on machine power up. It should be noted that the profile processor records and organizes paper attributes for a plurality of copy sheet sources. At block 304, the profile processor attributes such as sheet size are stored or located in a suitable memory location as illustrated by the sheet size array 306. Also for each copy sheet source, the profile processor calculates various jam times or process times as illustrated at block 308 and suitably stores the appropriate time periods in a suitable result store as shown at 310. It should be noted that each size or type of copy sheet may require several jam time periods for various sensors located throughout the machine along the paper path related to various transport characteristics and speed times required throughout the imaging process. Also as paper sizes are changed in any of the sources at any time, there is an update of the various jam and process times to relate to the changed paper size. For further details, reference is made to the above cited Ser. No. 08/208,250, assigned to the same assignee as the present invention and incorporated herein.

Timing and jam detection windows for paper handling, document handling and finishing in reprographic machines are generally set up based on nominal predetermined values. However, the actual timing at various monitoring locations usually shifts for specific machines based on variations of parts and response time of components. In accordance with the present invention, the actual timing such as the arrival time at desired locations in a given machine is determined by running a given number of sheets through the machine to automatically determine actual timing as opposed to nominal or preset reference timing. It should be noted that part of the running of sheets could be performed at the final run and test of the machine at the end of the manufacturing process. This information is conveyed to the main machine controller to automatically setup jam detection timing by eliminating tolerance of parts and component response time variations. This method provides more precise timing set up and reduces false shutdowns, machine down time and paper waste.

Figure 5:
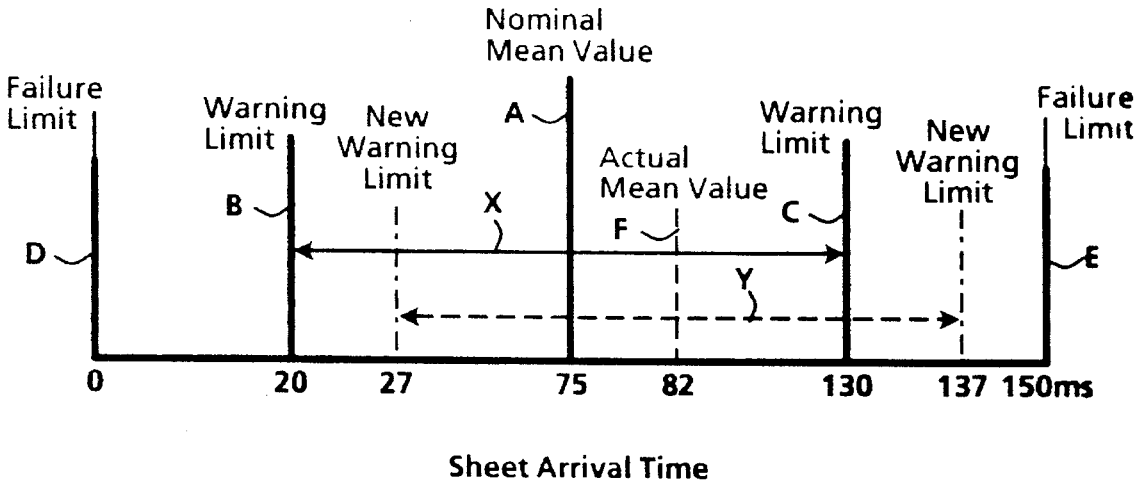
FIGS. 5 and 6 illustrate the changing of a jam detection window in accordance with the present invention.

The purpose is to ensure that the jam timing windows are centered about the actual mean value or other suitable standard for a given machine rather than a nominal design value. This method improves overall latitude by eliminating the effect of various tolerances as shown in FIG. 5. As will be described, a small variation in the actual arrival time can result in a significant change in timing latitude. This latitude is required to handle various papers as well as the effects of component wear and contamination. Shifting the warning limits to center around the actual timing will reduce the warning zone at the upper end, but at the same time it will improve the operating latitude which is directly related to shutdown rate.

This setup procedure can be repeated in the field as a maintenance action by a tech rep item or even by the customer. In another embodiment, the machine could use timing data from actual customer jobs so that the operation becomes totally transparent. In the case where a weight sensor is available, the actual mean value for each paper type can be determined, stored and utilized, to improve timing even further. In a production environment, is could be useful as an operator setup everytime a new paper type was used.

Figure 6:
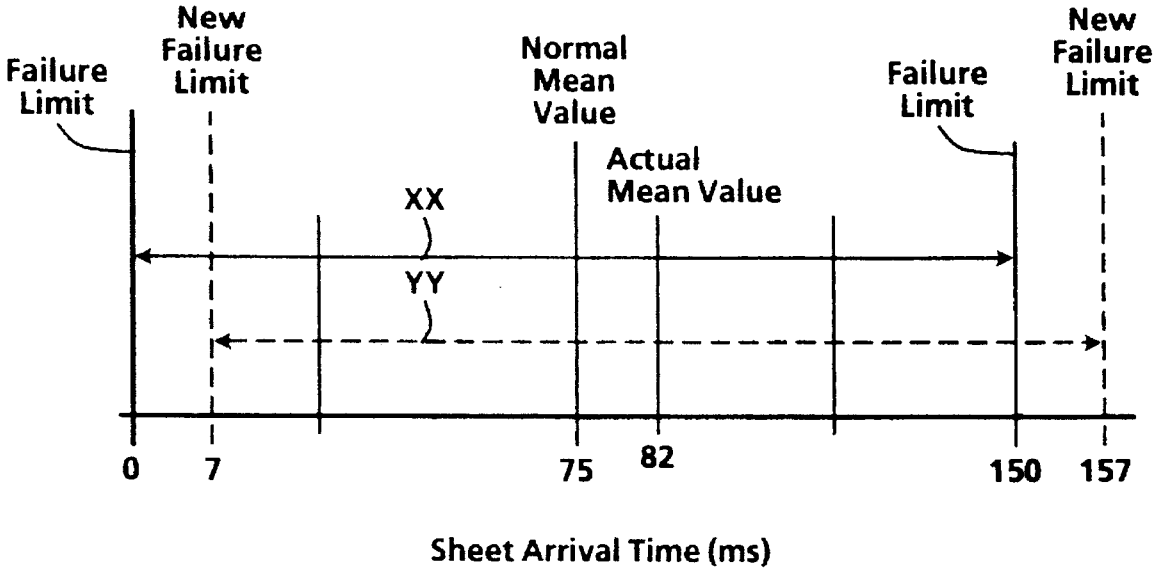

With reference to FIGS. 5 and 6, there is illustrated, in accordance with the present invention, the change of jam timing windows from a -reference design value to an actual mean value. The bar graphs illustratess a sheet or document arrival time at a given sensor from an upstream point or location. It should be noted that this is merely one example of a jam window that could be shown for a sensor measuring various operating parameters such as copy sheet or document arriving or departing times measuring the lead or trail edge of a given document or sheet.

Assuming the sensing of a distribution of sheet arrival times at a given sensor, bar A represents a nominal or preset mean value arrival time of 75 milliseconds. It is known in the prior art to establish failure limits in a machine for the arrival of paper at a given sensor or the departure of paper from a given sensor. If the arrival or departure of the paper with reference to a particular sensor falls outside the established failure limits, then the machine automatically shuts down. Vertical bars D & E at 0 and 150 milliseconds illustrate the early and late failure limits about a nominal mean value of 75 milliseconds. Bars D and E represent a 150 millisecond failure limit window centered about the mean arrival time of 75 milliseconds.

In accordance with the present invention, in addition to failure limits, it is possible also to establish warning limits to monitor the performance of a machine over time. These warning limits also initially depend upon the distribution of the arrival or departure times of sheets with reference to a given sensor about the nominal mean value. Assuming a warning limit jam window of 110 milliseconds, bar B sets the early warning limit at 20 milliseconds, 55 milliseconds earlier than the mean value 75 milliseconds and bar C sets the late warning limit at 130 milliseconds or 55 milliseconds later than the 75 millisecond mean value.

The horizontal bar shown at X thus establishes the 110 millisecond jam window centered at 75 milliseconds. Likewise, the horizontal bar XX illustrates the preset failure limit window of 150 milliseconds about a nominal mean value of 75 milliseconds. It should be noted that these jam window can represent predetermined design standards established at a factory site or at least before there exists any actual job production run experience at a customer site for actual customer requirements.

In actual operation, however, due to different characteristics of components, due to the machine environment, and due to various operating characteristics, the actual movement of documents or sheets through a machine may not necessarily conform to the preset or nominal design latitude as shown by bars A, B C, D, and E. For example, the actual mean value of sheets arriving at the given sensor may be 82 milliseconds time duration from the upstream location or point, as illustrated by bar F. Thus, the actual shut down failure latitude or the warning limit latitude as shown by bars B, C, D, and E are skewed with respect to the actual mean value bar F. That is, there is a 62 millisecond window upstream from the actual mean value at F to the warning limit at B and only 48 milliseconds from the actual mean value bar F with actual mean value 82 milliseconds to the warning limit at 130 milliseconds. This skew of the distribution sheet arrival times with respect to the outside limits applies as well to the machine shutdown or failure limit jam window. Such a lopsided jam window will result in unnecessary jam fault declarations.

It should also be noted that it is generally known that paper or copysheet motion is triggered to certain events. This relationship varies in different machines. In some machines, where the paper or sheet motion is synchronous and mechanically coupled, it is preferable to adjust the start time of the sheet to center or synchronize the arrival at a particular station. For example, in a system where a sheet feeder feeds a sheet to a registration station for transfer, the registration system may have no capability to adjust timing to synchronize the transfer of an image on the photoreceptor to the copysheet. In these cases, it is preferable to adjust the start time of the copysheet. On the other hand, in systems such as servo systems where the registration time can be adjusted, the jam window failure limits can be adjusted. Thus, in accordance with the present invention, there are various timing considerations for a given machine to adapt jam detection windows. For example, as discussed above, the actual failure limits or jam window can be adjusted or the start time of a given copysheet can be adjusted to adapt a machine to changing jam conditions.

In accordance with the present invention, a set of copy sheets are cycled through the machine either independently of actual job reproduction runs or as part of job reproduction runs to establish an actual mean value as illustrated by bar F. In response to the actual mean value, for example, 82 milliseconds, of the sheet arrival time at a given sensor, the failure limit window is shifted as illustrated by the horizontal bar YY to set new limits of 7 and 157 milliseconds about the actual mean value of 82 milliseconds. In a similar manner, new warning limits can be established as illustrated by horizontal bar Y giving a new shut down latitude of plus or minus 55 milliseconds on either side of the actual mean value 82 milliseconds. In essence, the preset or design shut down latitude about the nominal mean value 75 milliseconds has been shifted to establish the new limits.

Figure 7B:
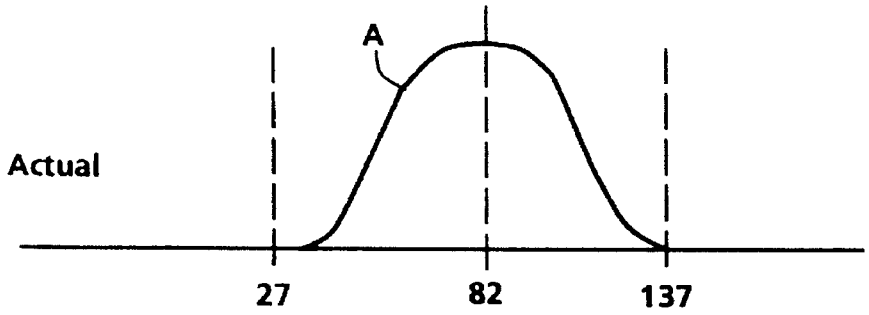

FIGS. 7A, B, C, & D further illustrate the above example. For example, FIG. 7A illustrates the distribution of the sheet arrival times as shown by curve A about a nominal mean value of 75 milliseconds. FIG. 7B illustrates the actual sheet arrival distribution of sheet arrival times at a given sensor centered at an arrival time of 82 milliseconds. With the warning limits at 20 and 130 milliseconds shifted to 27 and 137 milliseconds.

Figure 7C:
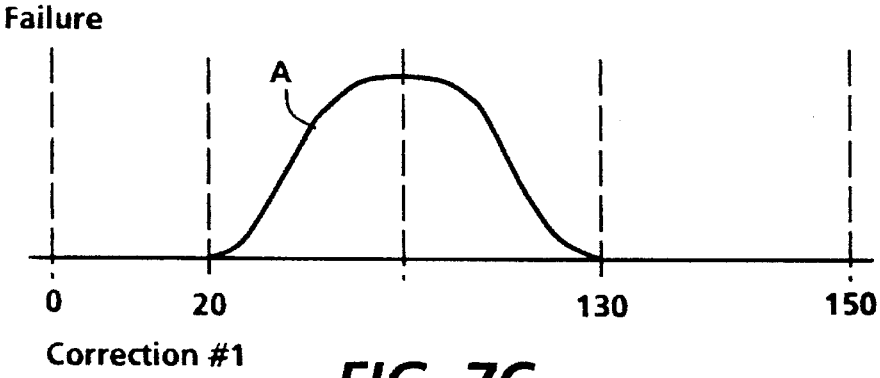
Figure 7D:
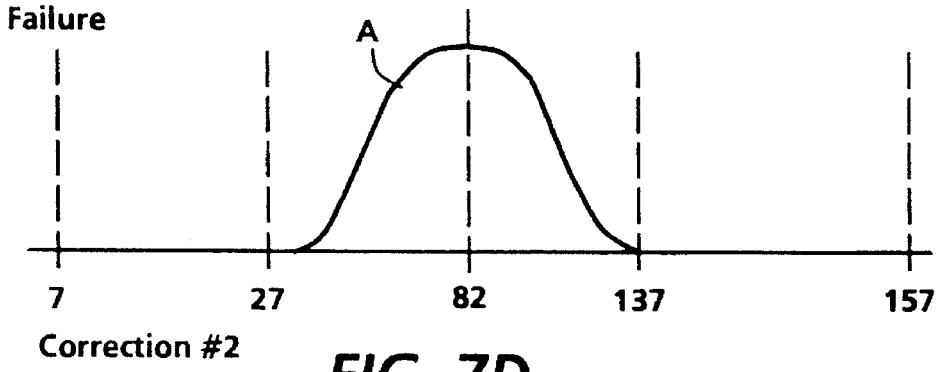

FIGS. 7C and 7D illustrate two methods of correction of the machine control to compensate for the difference between the actual sheet arrival time distribution from the nominal set up sheet arrival time distribution. For example, in FIG. 7C, rather than shift the window as illustrated in FIG. 7D, FIG. 7C illustrates the adjustment of sheet feeding start time to center around the failure limits. For example, in feeding a sheet to a specific location, rather than move the timing window, the correction is made by merely adjusting the time that the copysheet is fed. This in effect adjusts the sheet arrival time distribution to conform with the actual mean value. It should be understood that each sensor in the machine provide its own sheet arrival or departure time distribution or its own unique timing signature.

It should be understood that in accordance with the present invention, each of these signatures is determined in the machine control. During operation of the machine, the distribution signature for each sensor is individually corrected by either shifting the failure limit or warning limit timing windows or adjusting a start time relative to sheet feeding to compensate for an actual sheet distribution with reference to a nominal sheet distribution. The correction for a given sensor can be either one of adjusting the timing window or a start timer or a combination of these two methods.

It should be noted that it is within the scope of the present invention to cycle a set number of sheets through the system to establish actual shut down or warning limit latitude about an actual mean value at any convenient time during the operation of the machine or while the machine is in a diagnostic mode. The key is that the jam timing windows are periodically evaluated and, if necessary, a corrective adjustment to the location of the jam timing window is made. It should be noted that this adjustment can be made for each of the document or sheet sensors or can be done selectively for a given sensor. In particular, the jam timing windows are periodically adjusted to accommodate changing conditions of a machine or the changing environment in which a machine operates as well as a change in the devices or components themselves. Thus a given machine is not dependent upon preset or design criteria or timing windows that may not conform suitable to the actual machine operating conditions.

It should also be noted that the scope of the invention applies to various types or weights of documents or sheets and that the jammed timing windows can be adjusted as well for document or paper types that are slower or faster moving and that would ordinarily skew the jam timing windows set only to one design standard. As noted above, the jam timing window adjustments could be done automatically based upon sensor timing statistics taken during the operation of the machine and during actual job reproduction runs. This information in the form of exit and arrival times or travel times between sensors could be stored and accumulated at preferred times such as during machine stand by. Suitable calculations or averaging computations could be made to reset the jam timing windows. Also, the service representative in a diagnostic mode could cycle through an appropriate number of copy sheets or documents to provide the same measurements, calculations, and the resetting of the jam timing windows. A typical scenario in accordance with the present invention is illustrated in FIG. 8.

With reference to FIG. 8, block 320 represents the monitoring of a given sensor, sensor "n". As discussed above, the sensors can be monitored in sequence throughout the entire machine or at a selected sensor. Block 320 represents the recording of the particular time of arrival or other suitable time period with respect to sensor "n". At decision block 324, there is a determination whether or not the last sheet to be monitored has been fed. If not, at block 322 the next sheet is fed for a measurement to be taken at sensor "n". It should be noted that any suitable number of copy sheets or documents can be fed or used to established a mean value for a particular sensor. Once the last sheet has been monitored by sensor "n", for example sheet 20, the control will calculate a mean value for sensor "n" as shown at 326. As illustrated this could be a mean value or an average value or any other suitable value to establish the jam timing window. At block 328 there is a comparison of the calculated new mean value to an old mean value or design reference as stored in memory.

At block 330 there is a determination whether or not there is a change between the new mean value. That is, there is a determination or decision as to whether or not the newly calculated mean value for sensor "n" is equal to the reference value or previous value for sensor "n". If there is no change, then as illustrated at block 334 there is an increment in the sensor count and the cycle of 20 copy sheets is executed for the next selected sensor.

It should be understood that there are many variations of the embodiment as illustrated. For example, all 20 copy sheet could be cycled sequentially through each of the sensors and after the total 20 copy sheets has been cycled for each of the sensors, then the calculation for each sensor of the change in reference would be accomplished. Block 334 merely illustrates that there is a tracking of each sensor to obtain an appropriate number of readings or sensor monitoring to calculate a mean value to be compared with a stored reference. Decision block 336 determines whether or not the last sensor has been monitored and evaluated and if so the routine is ended. If not, the routine cycles to the next sensor again as illustrated at block 320. If there is a change in the mean value for sensor "n" then as shown at block 332, an appropriate adjustment is made for the mean value.

An evaluation is made at decision block 333 to determine if the deviation of the machine timing has moved to the extent that there is a diagnostic concern. Hard or absolute limits exist based upon relevant design rules determine if variations have exceeded allowable adjustment limits. Exceeding the absolute limit at decision block **333*a* results in a fault declaration at block 333*b***.

On the other hand, decision block **333*c* determines whether or not soft or adjustible limits are determined. A soft limit adjustment exceeded at 333*c* results in a diagnostic warning as shown at block 333*d***. These diagnostic alert messages can be stored in the machine's memory or transmitted to a local service center via a remote communications network.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus for producing images on copy sheets, the apparatus including a copy sheet path having a sensor for sensing the movement of copy sheets along the path and a controller for directing the image processing apparatus, the controller tracking the movement of the copy sheet along the copy sheet path, the control providing a reference for comparing with sensed signals from the sensor for determining the integrity of the movement of copy sheets in relation to the sensor, the reference relating to different copy sheet weights a method of adjusting the reference to accommodate changing machine conditions comprising the steps of:

sensing a series of copy sheets along the path at the sensor to provide real time sensed signals;

comparing the real time sensed signals with the reference provided by the control, and changing the reference in response to the real time sensed signals to accommodate changing machine conditions.

2. The method of claim 1 including a plurality of sensors along the copy sheet path and wherein each sensor provides a given reference.

3. The method of claim 2 wherein the references include a window of acceptable copy sheet arrival times.

4. The method of claim 2 wherein the references include to different copy sheet textures.

5. In an image processing apparatus for producing images on copy sheets, the apparatus including a copy sheet path having a plurality of sensors for sensing the movement of copy sheets along the path and a controller for directing the image processing apparatus, the controller tracking the movement of the copy sheets along the copy sheet path, the control providing references for comparing with sensed signals from the sensor for determining the integrity of each movement of copy sheets in relation to the sensor, the references being ranges of acceptable copy sheet travel times, references relating to different copy sheet weights a method of adjusting a reference to accommodate changing machine conditions comprising the steps of:

sensing a series of copy sheets along the path at the sensor to provide real time sensed signals;

comparing the real time sensed signals with the reference provided by the control, and changing the reference in response to the real time sensed signals to accommodate changing machine conditions.

6. In an image processing apparatus for producing images on copy sheets, the apparatus including a copy sheet path having a sensor for sensing the movement of copy sheets along the path and a controller for directing the image processing apparatus, the controller tracking the movement of the copy sheets along the copy sheet path, the control providing a reference for comparing with sensed signals from the sensor for determining the integrity of the movement of copy sheets in relation to the sensor, the reference relating to different copy sheet textures, a method of adjusting the reference to accommodate changing machine conditions comprising the steps of:

sensing a series of copy sheets along the path at the sensor to provide real time sensed signals;

comparing the real time sensed signals with the reference provided by the control, and changing the reference in response to the real time sensed signals to accommodate changing machine conditions.

7. The method of claim 6 including a plurality of sensors along the copy sheet path and wherein each sensor provides a given reference.

8. The method of claim 7 wherein the references include a window of acceptable copy sheet arrival times.

9. The method of claim 7 wherein the references include different copy sheet weights.

* * * * *